United States Patent [19]

Miller

[11] 4,074,612

[45] Feb. 21, 1978

[54] FLUID OPERATED HYDRAULIC PUMP

[75] Inventor: Douglas P. Miller, Milwaukee, Wis.

[73] Assignee: Applied Power Inc., Milwaukee, Wis.

[21] Appl. No.: 717,748

[22] Filed: Aug. 25, 1976

[51] Int. Cl.[2] ..... F01L 25/04; F01L 23/00

[52] U.S. Cl. ..... 91/290; 91/303; 91/341 R; 91/398; 91/448

[58] Field of Search ..... 91/341 R, 303, 398, 91/290

[56] References Cited

U.S. PATENT DOCUMENTS

| | | | |
|---|---|---|---|
| 3,041,975 | 7/1962 | Atherton et al. | 91/341 |
| 3,561,325 | 2/1971 | Lamb et al. | 91/341 |

*Primary Examiner*—Paul E. Maslousky
*Attorney, Agent, or Firm*—James E. Nilles

[57] ABSTRACT

A fluid operated hydraulic pump of the type using air pressure to produce high pressure hydraulic fluid wherein an air pressure driven motor and a hydraulic pump are positioned in adjacent axially aligned relationship and the air motor drives the hydraulic pump, the air motor including a reciprocable check valve for preventing air flow into the pump during the exhaust stroke of the pump thereby increasing the efficiency of the pump and reducing air flow through the pump. The check valve is disposed in the air inlet passage and is positioned in axially aligned relationship and adjacent to a reciprocable shuttle valve controlling exhaust air flow from the motor. Movement of the shuttle valve to a position permitting air to be exhausted from the air motor chamber also facilitates movement of the reciprocable check valve to a position wherein it prevents air flow into the motor.

6 Claims, 6 Drawing Figures

FLUID OPERATED HYDRAULIC PUMP

BACKGROUND OF THE INVENTION

The present invention relates generally to improvements in fluid driven hydraulic pumps and more particularly to improvements in fluid driven motors used in such hydraulic pumps to drive the hydraulic pumps.

Fluid actuated hydraulic fluid pressure producing units are shown, for example, in U.S. Pat. No. 3,041,975, issued July 3, 1962 to Atherton et al. in U.S. Pat. No. 3,463,053, issued Aug. 26, 1969 to Leibundgut, both of these patents assigned to an assignee in common with that of the present invention. Another type of similar device is shown in U.S. Pat. No. 3,788,781, issued Jan. 29, 1974 to McClocklin.

Fluid actuated hydraulic power units of the type referred to in the above patents are generally intended to use a source of fluid pressure, such as air pressure commonly used in garages, salvage operations, or in industrial applications, and at pressures on the order of 100 psi, to supply high pressure hydraulic fluid at pressures on the order of 10,000 psi to operate hydraulic fluid motors or other hydraulic tools. Such hydraulic power units include a reciprocating piston air motor, the piston being driven by air pressure and functional to reciprocate a piston of a hydraulic pump to thereby drive the hydraulic pump and supply high pressure hydraulic fluid through an output passage to a hydraulic tool or the like.

A disadvantage of the prior art fluid actuated hydraulic power units is that the air motors used therein operate in such a manner that air flows through the air motor continuously during both the input stroke and the exhaust stroke of the air motor piston. During the exhaust stroke of the air motor, air flow into the air motor is unnecessary, and the input air must be diverted directly through the motor to the motor exhaust port and thus to the ambient atmosphere. As a result of the continuous flow of compressed air through the air motor, the prior art apparatus is relatively ineffecient in that it employs unnecessary amounts of compressed air and it has the further disadvantage that the large volume of air flowing through the air motor creates an undesirable and unnecessary noise level. The noise generated by the air motor is particularly noticeable during the exhaust stroke of the air motor when the compressed air in the air motor chamber is forced through an exhaust passage and at the same time the air being supplied to the air motor is also being exhausted through this air passage. The resulting high volume of air flowing through this exhaust passage at a high velocity creates a substantial noise level.

SUMMARY OF THE INVENTION

The present invention provides an improved fluid operated power unit having a plurality of advantages over the prior art and particularly including means for regulating the air flow into the power unit such that the air flow is interrupted during each exhaust cycle of the fluid motor and such that air flows into the air motor only during the intake stroke of the air motor. Consequently, the only air which passes through the exhaust ports of the air motor is that which is used directly to drive the motor. As a result, volume and velocity of air flow through the air motor embodied by the present invention is less than is required by air motors of the prior art whereby the efficiency of the air motor of the invention is substantially greater and the noise level generated by the air motors is substantially reduced.

The improved fluid operated hydraulic power unit of the invention includes an air motor having a motor body which includes a cylinder for receiving a reciprocating piston in turn functional to drive a hydraulic fluid pump. The air motor body also includes an inlet passage to permit compressed air to be forced into the air motor cylinder to drive the piston and an exhaust passage communicating with the cylinder and with the ambient atmosphere. The inlet passage houses both a reciprocable throttle valve which is provided as a means for controlling the fluid flow through the inlet passage and a reciprocable check valve which reciprocates during each stroke of the air motor piston to prevent air flow into the air motor cylinder during each exhaust stroke of the piston. Exhaust from the air motor cylinder is controlled by a reciprocable shuttle valve which is receivable in the exhaust passage and in axial alignment with the reciprocable check valve. The shuttle valve controlling the exhaust flow and the check valve are positioned in axially aligned adjacent relationship and are secured together such that the axial movement of the shuttle valve to a position opening the exhaust passage causes axial movement of the check valve to a position wherein flow through the inlet passage is prevented and axial movement of the shuttle valve to a position preventing air flow through the exhaust passage causes the check valve to be moved axially to a position permitting air flow through the inlet passage into the air motor chamber.

Further advantages of the present invention will become apparent from the following description of the preferred embodiment.

DESCRIPTION OF THE PREFERRED EMBODIMENT

Figure 2:
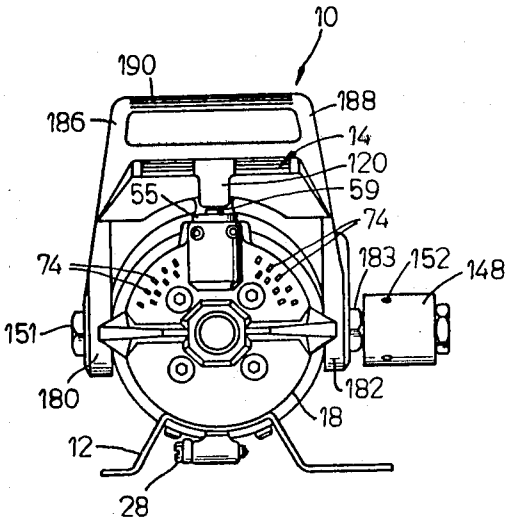
FIG. 2 is an end elevation view of the power unit shown in FIG. 1.

Referring to the drawings, the power unit shown therein as embodying the invention comprises, in general, a unitary body 10 supported by a base 12 and having an actuating lever or treadle 14 pivoted thereon. The body 10 includes a fluid or air motor portion 16 closed at one end by an air motor valve block 18 and having a hydraulic reservoir housing 20 extending from its opposite end and a hydraulic pump valve block 22 interposed between the air motor 16 and the hydraulic reservoir housing 20. The body 10 is of generally cylindrical shape, and the air motor portion 16, air motor valve block 18, hydraulic reservoir housing 20, and hydraulic pump valve block 22 are in axial alignment. The air motor 16 and the air motor valve block 18 are shown as being comprised from plastic and can be advantageously formed by injection molding, however, a plurality of other materials such as die cast aluminum could be used. The air motor 16 is secured to the hydraulic pump valve block 22 by a restraining band 24 which can be received around an end portion 17 of air motor 16 whereby that end of the plastic air motor can be clamped against a projecting annular end 26 of the hydraulic valve block 22 by means of a tightening screw 28. The hydraulic reservoir housing 20 is comprised in part of a cylindrical sleeve 21 which includes an open end which is received around an end 27 of the hydraulic valve block 22 and secured thereto by screws 30.

Live air or other pressurized fluid from a suitable source 32 (FIG. 3) is admitted through a conduit 33 to the air motor valve block 18 by means of an air inlet coupling 34, which is threadably received within a bore 35 in the valve block 18, and high pressure hydraulic fluid is discharged from the hydraulic pump valve block 22 through a high pressure pump outlet swivel coupling 36.

Air Motor

Referring to the air motor 16 and air motor valve block 18 shown in FIGS. 3–6, air from the supply source 32 is intended to pass through the air inlet coupling 34 and through an air filter 38 threadably journalled therein and within the bore 35. The flow of air through the air inlet coupling 34 is governed by a check valve poppet 40 which includes a flange 42 at one end receivable against a valve seat 44 (FIG. 4) to prevent fluid flow into the air motor. The check valve poppet 40 is axially slideably supported in an axial bore 46 in the air motor valve block 18 and is co-axial with the longitudinal axis of the air motor 16, hydraulic reservoir housing 20, and hydraulic valve block 22, and the axial position of the check valve poppet 40 is governed by a spring biased shuttle valve 48 as will be described hereinafter. When the check valve poppet 40 is in a position to permit air flow into the bore 46 (FIG. 3), the air will then flow through a supply passage 50 (FIG. 5) in the air valve block 18 to a cylindrical bore 52 housing an actuating throttle valve assembly 54. The actuating throttle valve assembly 54 is slideably received in the bore 52 and fluid-tight relationship is maintained by resilient O-ring seals 56. The actuating throttle valve assembly 54 includes a generally cylindrical valve body 55 and a slideable throttle valve poppet 57 which is axially movable within a bore 58 in the valve body 55 and which includes a flange 60 at one end normally seated against a valve seat 62 of the valve body 55 and biased toward a fluid flow restricting position by air pressure in the supply passage 50. The valve body 55 also includes a port 64 therethrough in open communication with the axial bore 58 in the valve body 55 and intended to facilitate air flow through an axial supply passage 66 in the air valve block 18 and air motor 16 whereby air can be supplied to the air motor displacement chamber 68.

The air motor portion 16 also includes an axially aligned stepped bore or cylinder 70 adjacent its end wall 71, the bore 70 being defined by a generally tubular axially projecting sleeve 72 which is receivable in fluid-tight relationship within the air motor valve block 18. The stepped bore 70 slideably houses the shuttle valve poppet 48 which is in turn functional to permit exhaust from the chamber 68 through an exhaust port 85 and into an annular expansion chamber 87 in the air motor valve block 18 and finally through exhaust ports 74 in the air motor valve block 18. The shuttle valve poppet 48 is positioned in axial alignment with and can be secured to the check valve poppet 40 by a screw 83 received through shuttle valve poppet 48 and threadably received in a bore **40*b* in the check valve poppet 40 such that the shuttle valve poppet 48 is functional to control axial movement of the check valve poppet 40. The shuttle valve poppet 48 also includes a molded resilient piston portion 75 at one end and axially slideable within the bore 70. A coil spring 76 is positioned between an annular inwardly projecting flange 78 of the air motor 16 and the piston portion 75 of the shuttle valve poppet 48. A circular disc-like resilient seal 82 is secured by means of a backup washer 82*a* and the screw 83 to the end of the shuttle valve poppet 48 opposite the piston 75 and is normally received against a seat 84 of the annular flange 78 to prevent exhaust of air from the chamber 68 through the bore 70**.

The air motor 16 also includes a cylinder 86 which defines the air motor displacement chamber 68 and which receives an axially movable piston 90 therein. A fluid-tight seal is maintained between the cylinder walls of the cylinder 86 and the periphery of the piston 90 by a resilient seal 108. In order to permit reciprocation of the piston 90 in the displacement chamber 68, fluid communication between the ambient atmosphere and that portion of the chamber 68 between the piston 90 and the hydraulic valve block 22 is provided by means of an air passage shown in FIG. 3 defined by a port **92*a* through the wall of cylinder 86 and a longitudinally extending passage 40*a* which communicates with the expansion chamber 87. The piston 90 also includes an annular groove 110 surrounding its circumference and a plurality of ports 112 to provide communication between the displacement chamber 68 and the groove 110 and to permit air flow through the port 92*a* as the piston 90** reaches the end of its forward stroke.

The displacement chamber 68 is also vented through a port 92 which is remote from the air motor valve block 18 and in communication with the bore 70 a passage 94, and through a passage 96 in the air motor valve block 18. The port 92 is positioned such that it is adapted to be uncovered by the air motor piston 90 only when the piston 90 reaches the end of its forward stroke.

Seated against the front face of the air motor piston 90 is a small diameter hydraulic fluid pump piston 98 receivable in a cylinder 99 and operable to pump hydraulic fluid through passages in the hydraulic block 22 as will hereinafter more fully appear. The rear of the hydraulic pump piston 98 extends into the air motor displacement chamber 68 and is formed with an enlarged head 100 having a rounded or spherical bearing surface 101 urged against a complementary rounded surface 102 in the face of the piston 90 by a spring 104 compressed between and seated against the rear of the hydraulic valve block 22 and an annular disc 106 supported by the pump piston 98 and adjacent to its head end 100.

Air Motor Operation

Figure 3:
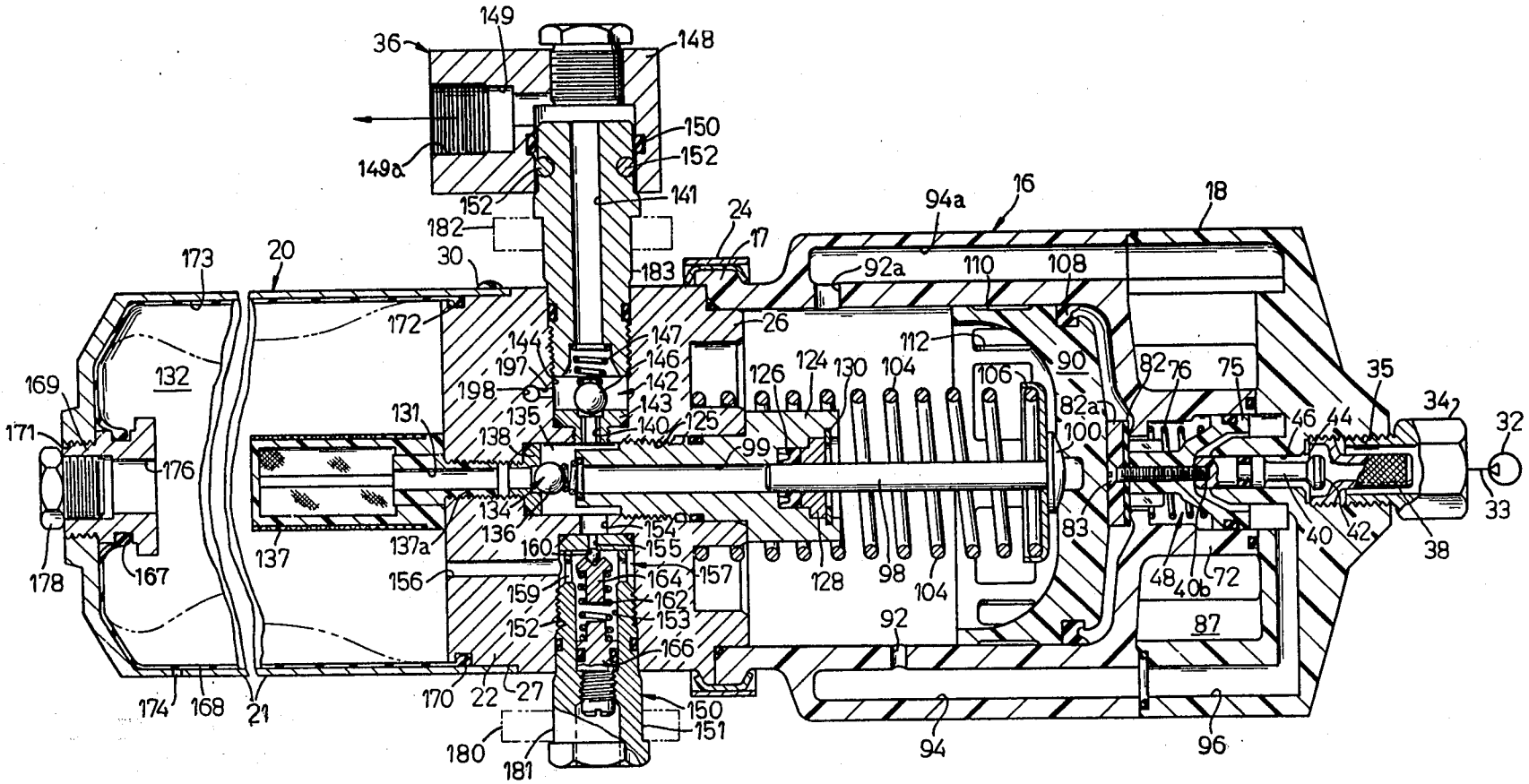
FIG. 3 is a cross-sectional plan view of the power unit shown in FIG. 1 and is taken generally along line 3—3 of FIG. 1.
Figure 4:
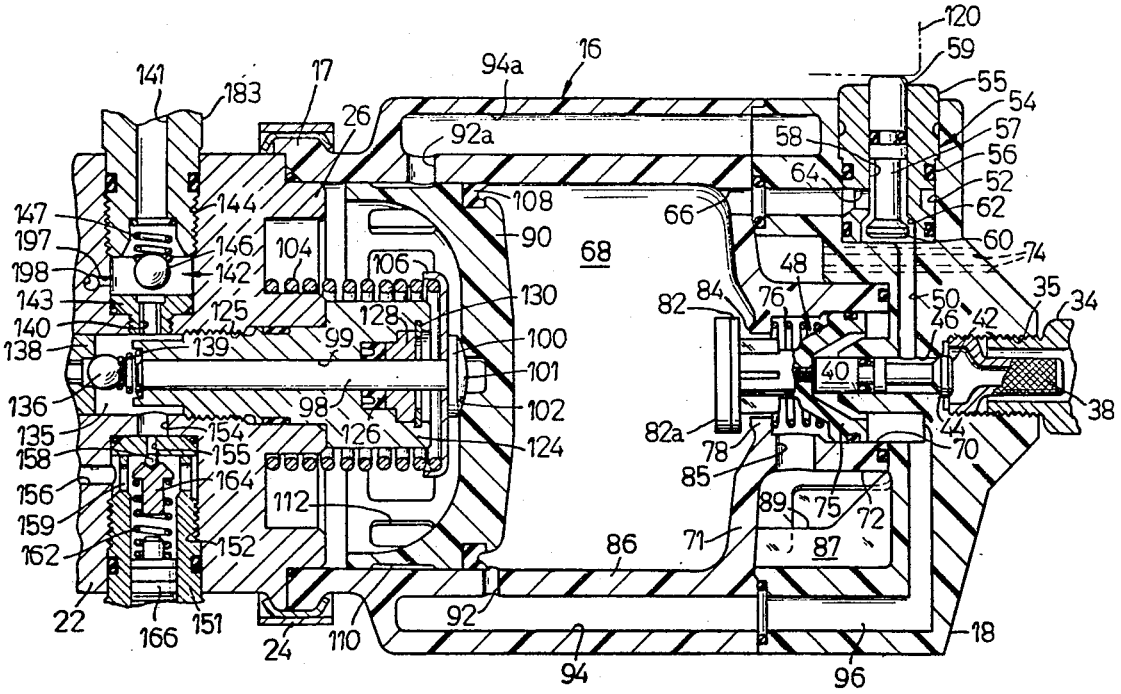
FIG. 4 is a partial cross-sectional plan view similar to FIG. 3 but distorted to show the air motor throttle valve generally in a side elevation cross-section and showing the air piston of the air motor in its fully extended position.

In operation and assuming that the piston 90 begins its reciprocable movement in the position shown in FIG. 3, wherein the force of the spring 104 urges the piston 90 against the shuttle valve poppet 48 thereby causing the check valve poppet 40 to move axially in bore 46 and the flange 42 thereof to be moved away from the valve seat 44 whereby air can pass through the bore 46 into the passageway 50 (FIG. 4). To cause actuation of the air motor, the operator depresses treadle 14 such that the tab 120 (FIG. 6) at the end of the treadle 14 engages the upwardly projecting end 59 of the actuating throttle valve poppet 57 thereby moving the flange 60 away from the valve seat 62 and permitting compressed air to flow from supply passage 50 through passages 64 and 66 into the cylinder cavity 68. The resulting air pressure in cavity 68 will force air piston 90 and the hydraulic fluid piston 98 to the position shown in FIG. 4 thereby providing a hydraulic fluid pumping effect. Such movement of the piston 90 to the end of its stroke will uncover the port 92 thereby permitting compressed air in the displacement chamber 68 to communicate through passage 94 and 96 with the cylinder 70. The compressed air flowing through passages 94 and 96 into the cylinder 70 will cause the piston portion 75 of the shuttle valve poppet 48 and the check valve poppet 40 attached thereto to move to the left to the position shown in FIG. 4 against the force of the spring 76. Movement of the piston portion 75 to the position shown in FIG. 4 causes the flange 42 of the check valve poppet 40 to be received against the seat 44 thereby restricting further flow of air through the passage 50 into the air motor 16.

When the piston portion 75 of the shuttle valve 48 moves to the position shown in FIG. 4, the disc 82 also moves away from the seal 84 thereby permitting the compressed air within the displacement chamber 68 to exhaust through the bore 70, through the exhaust port 85, into the annular expansion chamber 87 containing a number of baffles 89, and finally through the plurality of small exhaust passages 74.

Figure 5:
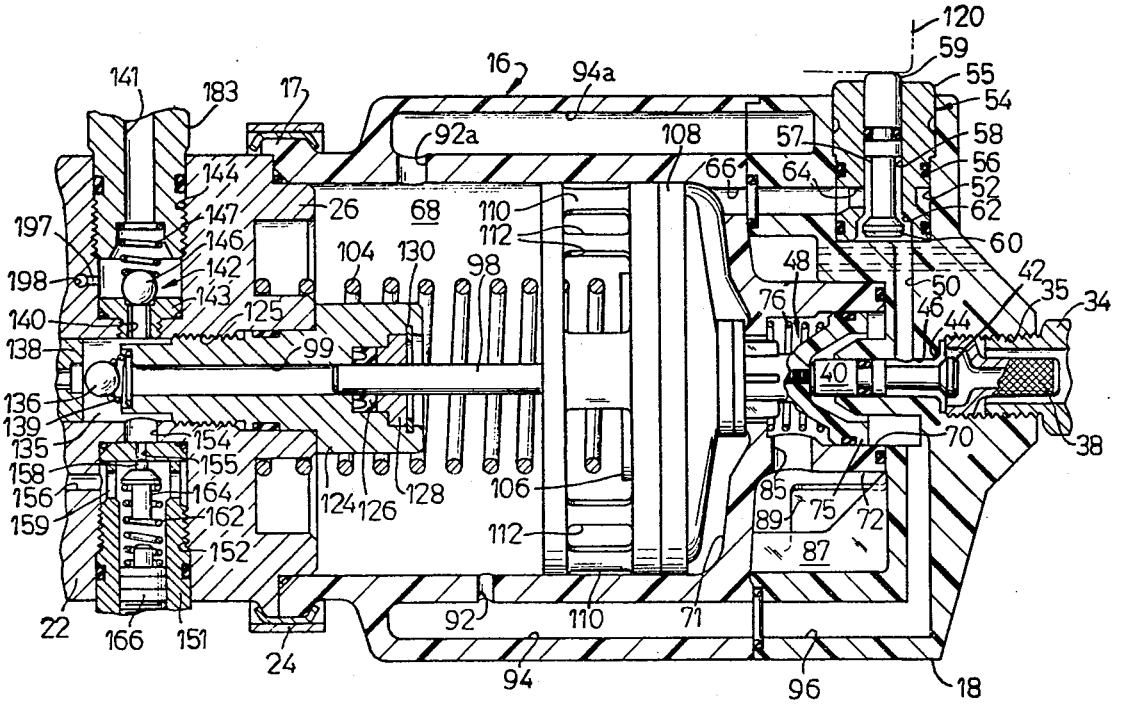
FIG. 5 is a view similar to FIG. 4 but showing the air piston in a retracted position.

As the compressed air is thus exhausted from the displacement chamber 68, the spring 104 forces the piston 90 to return toward its original position as shown in FIG. 3. As shown in FIG. 5, as the piston 90 nears its original position, the piston 90 contacts the screw 83 and backup washer **82*a* thereby causing the shuttle valve poppet 48 and the check valve poppet 40 to be forced to the right and continued movement of the piston 90 causes the disc 82 to be received in sealing engagement against the seal 84 to prevent further exhaust flow from chamber 68 and simultaneously forces the flange 42 of the check valve poppet 40 away from the seat 44 to permit air flow from the supply source 32 into the passage 50. Furthermore, it will be appreciated that before the piston 90 reaches the end of its return stroke, the flange 42 of the check valve poppet 40 is forced away from the seat 44 sufficiently that air flow through the passage 50 and into the displacement chamber 68 will effect damping of the return stroke of the piston 90. As long as the treadle 14 is depressed and the actuating throttle valve 57 is open, whereby passage 50 and the passages 64 and 66 are in communication, the air motor will continue to pump in a similar fashion as that described above until hydraulic fluid pressure in the cylinder 99** reaches a desired level.

Hydraulic Fluid Pump

In this manner, the hydraulic pump piston 98 is thus caused to reciprocate within the hydraulic pump cylinder 99 by the combined action of the air motor piston 90 and the return spring 104. While the hydraulic pump cylinder 99 may be formed directly in the hydraulic pump valve block 22, it is preferably formed as shown in a readily removable and replaceable cartridge 124 which is threadably received within a bore 125 in the hydraulic valve block 22. Fluid-tight relationship between the hydraulic piston 98 and cylinder 99 is maintained by a seal 126 secured within the cartridge 124 by a backup ring 128 and a snap ring 130. The hydraulic circuitry of the hydraulic pump is encased within the hydraulic valve block 22 (FIG. 3) and comprises in part a suction or supply passage 131 extending from the hydraulic reservoir 132 within the hydraulic reservoir housing 20 past a spring biased ball check valve 134 to the hydraulic pressure chamber 135. The ball check valve 134 includes a ball 136 being seated against a removable seat 138 to close the passage 131 during the forward stroke of the piston 98 and being unseated to open the passage 131 during the return or suction stroke of the piston 98. The ball 136 is biased against the seat 138 by a spring 139 supported by the end of the replaceable cartridge 124. The passage 131 extends through a generally hollow cylindrical hydraulic fluid filter 137 which is threadably secured within a bore **137*a* in the hydraulic valve block 22 and which extends into the reservoir 132. The fluid filter 137 is constructed from a material which permits hydraulic fluid to flow through it but which prevents impurities from entering the pumping chamber 135**.

The hydraulic valve block 22 also includes a high pressure discharge or outlet passageway 141 past a one-way ball check valve 142. The ball check valve 142 is comprised of a valve seat 143 threadably and removably secured within a bore 144 in the hydraulic valve block 22 and a check ball 146 biased against the valve seat 143 by a spring 147. The outlet passage 141 is defined by an axially extending bore 140 through the valve seat 143 and by a longitudinal bore through a cylindrical sleeve 183 which has one end threadably secured within the bore 144 of the valve block 22 and another end supporting a freely rotatable coupling member 148 of the swivel coupling 36. The coupling member 148 includes a stepped central bore 149 therein in communication with the passage 141, the central bore 149 including a threaded end **149*a* for threadably receiving a hydraulic hose or the like. A fluid-tight seal is maintained between the coupling member 148 and the cylindrical sleeve 133 by a resilient O-ring 150 and relative rotation of the coupling 148 around the end of the sleeve 183 is facilitated by a pair of retaining pins 152 extending through the coupling member 148 and receivable in a circumferential groove 152*a* in the sleeve 183**.

Also formed in the valve block 22 is a relief valve assembly 150 comprising a generally cylindrical valve housing 151 threadably secured within a bore 152 in the valve block 22, the relief valve assembly 150 intended to provide communication of hydraulic fluid between the hydraulic pressure chamber 135 and the reservoir 132 in the event the fluid pressure in the pressure chamber 135 becomes too great. A port 154 in the valve block 22 extends from the hydraulic pressure chamber 135 into the bore 152 and a similar but transverse bore 156 extends from the bore 152 into the hydraulic reservoir 132. The cylindrical valve housing includes a central chamber 153 in communication with the port 154 through a bore 155 and similarly in communication with transverse bore 156 through a bore 159, however, fluid flow therethrough is prevented by means of a spring biased check valve 157 in the valve housing 151, the check valve 157 being comprised of a ball 158 received against a seat 160 and biased thereagainst by a spring 162 and a ball support member 164. The biasing force of the spring 162 can be adjusted by an accessible screw 166.

The oil in the reservoir 132 is confined within a container formed by a flexible membrane or bladder 168 having a generally cylindrical shape and having one end reversed inwardly and received in fluid-tight relationship in a circumferential groove 167 around a cylindrical plug housing 169 threadably received in a bore 171 in the end of the hydraulic reservoir housing 20. The outer end of the container 168 is secured between the wall of the hydraulic reservoir housing 20 and the circumferential periphery of the valve block 22 and includes a circumferential bead 170 received within a circumferential groove 172 around the hydraulic valve block 22. The chamber 173 of the hydraulic reservoir housing 20 supporting the flexible membrane 168 is vented to the atmosphere by means of a vent hole 174. To permit access to the interior of the flexible membrane 168 for re-filling and like purposes, a suitable passageway 176 is provided within the plug housing 169 and is closed by a threaded plug 178.

Figure 1:
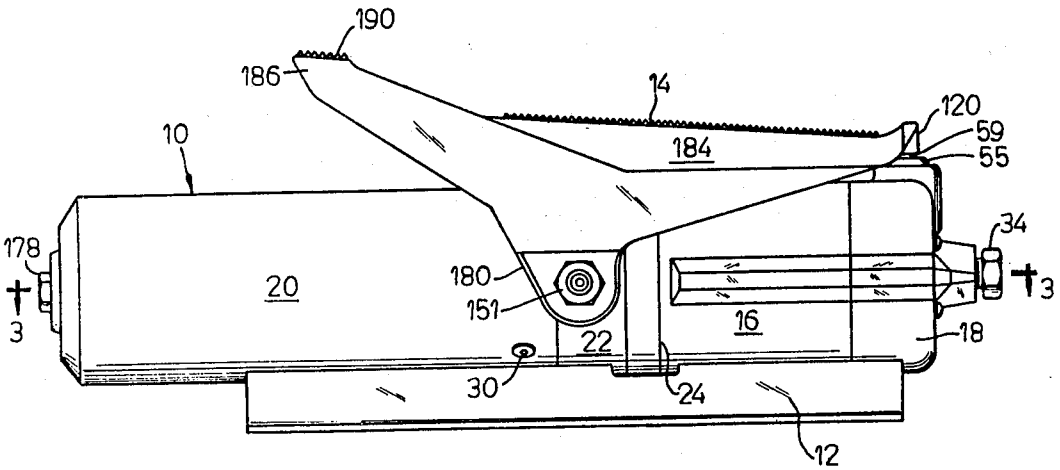
FIG. 1 is a side elevation view of a fluid actuated hydraulic power unit of the present invention.

As previously indicated, the throttle valve 57 is actuated by downward movement of the treadle 14. While the design of the treadle 14 may, of course, be varied, it is preferable that the treadle 14 be pivotally mounted or supported at a point intermediate the ends of the hydraulic pump. Treadle 14 is shown in FIGS. 1 and 2 as including a pair of downwardly extending lobes 180 and 182 at its opposite sides, these lobes including bores therein and being respectively pivotably supported by a cylindrical shaft portion 181 of the cylindrical valve housing 151 and by the cylindrical shaft portion of the cylindrical sleeve 183 whereby the treadle 14 is supported for pivotal movement about a horizontal axis. In its preferred form, the treadle 14 is of integral one-piece construction and has a longitudinally rearwardly extending treadle portion 184 in turn having an end 120 positionable above the upwardly projecting end 59 of the throttle valve 57 to permit actuation of the throttle valve 57 upon downward application of pressure upon treadle portion 184. The treadle 14 also includes a pair of forwardly and upwardly directed side arms 186 and 188 joined at their upper and forward end by a cross piece 190.

Hydraulic Pressure Release Mechanism

Figure 6:
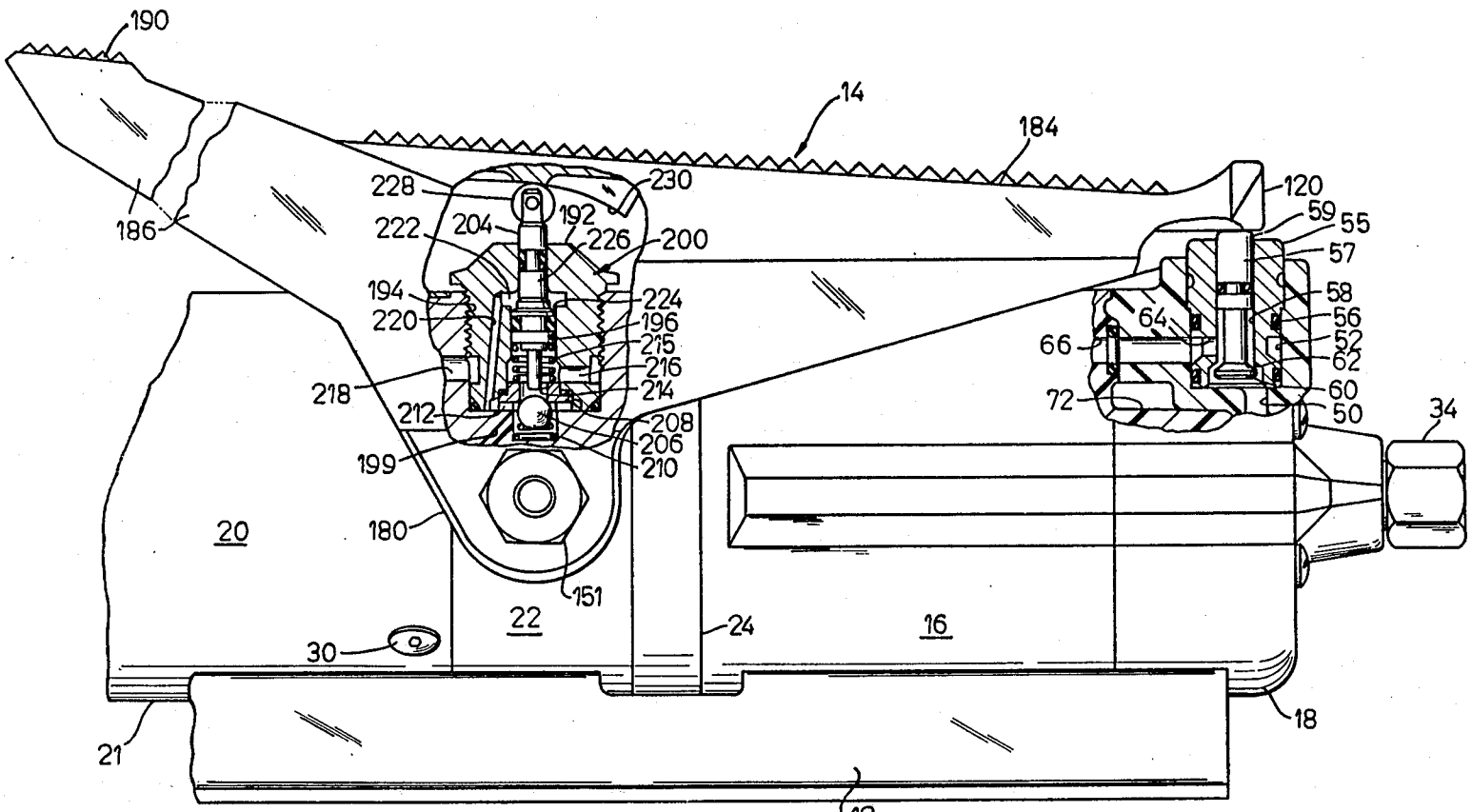
FIG. 6 is an enlarged partial view of the power unit shown in FIG. 1 with portions cut away in the interest of clarity.

To release the pressure developed in the high pressure hydraulic output passage 141 upon completion of the desired work, a release valve assembly 200 is provided, operable for providing fluid communication between the output passage 141 and the hydraulic reservoir 132. A threaded bushing 192 is threadably removably secured within a threaded bore 194 in the hydraulic valve block 22 and the bushing 192 includes a central concentric stepped bore 196 therein communicating with the output passage 141 through a plurality of passages 197 (FIG. 3) 198, and 199 (FIG. 6). The bore 196 houses a reciprocable plunger 204 and a spring biased check ball 206 which is receivable against a removable valve seat 208 and biased there against by a spring 210. The reciprocal plunger 204 is biased away from the ball 206 by a spring 215 in turn supported against valve seat 208. The fluid passage 199 which is in communication with the output passage 141 by means of passages 197 and 198 is also in communication with an annular chamber 212 of the stepped bore 196. Due to the high hydraulic fluid pressures created within the output passage 141 and consequently within the chamber 212, the check ball 206 is forced against the seat 208 with substantial force. It is desirable, however, that the plunger 204 be easily movable to unseat the ball 206 in order to release fluid pressure in the output passage 141, i.e., to permit fluid flow from the chamber 212 through the bore 214 in the seat 208 and consequently through the passage 216 and through a passage 218 into the reservoir 132. To thus facilitate reciprocation of the plunger 204 and movement of the ball 206 away from valve seat 208, a passage 220 is provided connecting the chamber 212 with an annular chamber 222 in the stepped bore 196. Furthermore, the plunger 204 is provided with a stepped configuration and an annular flange 224 adjacent the annular chamber 222. The differences between the cross sectional areas between the upper end 226 and the flange 224 is only slightly less than the effective cross sectional area of the bore 214 and the fluid pressure upon the flange 224 and the upper end 226 will be equal to the fluid pressure upon the ball 206. Thus, the forces on the ball 206 and the plunger 204 will be substantially balanced and the necessary downward force on the plunger 204, which is necessary to force the ball 206 away from the seat 208 to permit fluid flow through the bore 214, will be relatively small. In order to further provide means for easy manipulation of the plunger 204, the upper end of the plunger supports a roller 228 receivable against a curved cam surface 230 comprising an integral configuration of the lower portion of the treadle 14. The curved cam surface 230 is particularly provided with a configuration such that the wedge angle between the cam surface and the roller 228 is very slight when the cam surface 230 and plunger 204 are in the position shown in FIG. 6. Pivotal movement of the treadle 14 in the counterclockwise direction as seen in FIG. 6 will generate a downward force on the plunger 204 whereby the check ball 206 can be biased away from the seat 208 and hydraulic fluid caused to return to the reservoir 132. The cam surface has the particular configuration that as the treadle 14 is further depressed and cam surface 230 moves relative to the plunger 204 the wedge angle increases. This construction facilitates substantial reciprocal travel of the valve plunger 204 once the ball 206 has been unseated thereby facilitating increased fluid flow back to the reservoir once the ball 206 has been unseated.

I claim:

1. A fluid driven motor comprising:

a motor body having a motor chamber formed therein, said motor chamber having an end wall, an inlet passage in communication between said motor chamber and a fluid source, and an exhaust passage in communication between said motor chamber and a point of pressure relief;

a motor piston reciprocable within said chamber for an intake stroke away from said end wall and an exhaust stroke toward said end wall;

a bore in said end wall and including an inlet port for said inlet passage and an exhaust port for said exhaust passage;

a reciprocably movable shuttle valve poppet including a piston portion in said bore and an exhaust port seal;

said exhaust port seal being located in said motor chamber for cooperating with said exhaust port for preventing fluid flow through said exhaust passage during said intake stroke of said motor piston and for permitting fluid flow through said exhaust passage during said exhaust stroke, said exhaust port seal being engagable by said motor piston when the latter nears the end of its exhaust stroke;

a reciprocable check valve poppet in said bore cooperating with said inlet port for preventing fluid flow through said inlet passage during said exhaust stroke of said motor piston and for permitting fluid flow through said inlet passage during said intake stroke;

means for connecting said shuttle valve poppet to said check valve poppet whereby movement of said exhaust port seal to open or close said exhaust port is accompanied by movement of said check valve poppet to close or open said inlet port, respectively;

biasing means in said bore for continuously acting on said shuttle valve poppet to releasably maintain said exhaust port seal in closed position and said check valve poppet in open position as said motor piston moves through its intake stroke;

means, including a passage, for supplying pressurized fluid from said motor chamber to said piston portion of said bore when said motor piston is near the end of its intake stroke for moving said shuttle valve poppet against the action of said biasing means to thereby move said exhaust port seal to open position and to move said check valve poppet to closed position;

said exhaust port seal being movable to closed position and said check valve poppet to open position by engagement of said motor piston with said exhaust port seal when said motor piston is near the end of its exhaust stroke; and a throttle valve in said inlet passage for controlling fluid flow through said inlet passage.

2. The fluid pressure driven motor set forth in claim 1 wherein said shuttle valve poppet, including said exhaust port seal and said piston portion, and said check valve poppet are in axial alignment and in end-to-end adjacent relationship.

3. A fluid actuated motor having a body and comprising:

a motor cylinder formed in one end of said body and defining a chamber therein;

a motor piston reciprocable within said chamber and movable in an intake stroke and an exhaust stroke; and a motor valve block closing an end of said motor cylinder, said motor valve block including an inlet passage in communication with said motor chamber, a throttle valve in said inlet passage for controlling fluid flow through said passage, a reciprocable check valve poppet in said inlet passage for controlling fluid flow through said inlet passage, an exhaust passage in communication with said motor chamber and communicating with a point of pressure relief, a bore, a reciprocable shuttle valve poppet including a reciprocable exhaust port seal in said motor chamber for controlling fluid flow through said exhaust passage from said motor chamber, and a piston portion in said bore and connected to said check valve poppet, and means for operating said shuttle valve poppet, said means comprising biasing means in said bore for continuously acting on said shuttle valve poppet and for maintaining said shuttle valve poppet in a position wherein said check valve poppet is open and said exhaust port seal is closed, an air passage connected between said air motor chamber and said piston portion in said bore for actuating said shuttle valve poppet against said biasing means when said motor piston nears the end of its intake stroke to open said check valve poppet and to close said exhaust port seal, said motor piston when near the end of its exhaust stroke being engagable with said exhaust port seal to close said exhaust port seal and to open said check valve poppet.

4. The fluid actuated motor set forth in claim 3 wherein said shuttle valve poppet, including said exhaust port seal and said piston portion, and said check valve poppet are in axial alignment and in end-to-end adjacent relationship.

5. In a fluid motor energizable from a source of pressurized fluid;

a motor chamber;

a motor piston in said motor chamber removable through an intake stroke and an exhaust stroke away from and toward, respectively, an end of said motor chamber;

a fluid inlet passage for supplying fluid from said source to said motor chamber;

a throttle valve in said fluid inlet passage for controlling fluid flow therethrough;

a fluid exhaust passage for exhausting fluid from said motor chamber;

a check valve poppet movable in said fluid inlet passage for controlling fluid flow through said fluid inlet passage;

a bore;

a reciprocably movable shuttle valve poppet including a piston portion in said bore and an exhaust port seal in said motor chamber for controlling fluid flow through said fluid exhaust passage;

means for connecting said check valve poppet and said shuttle valve poppet for movement therewith;

biasing means in said bore for continuously acting on said shuttle valve poppet and for releasably biasing said shuttle valve poppet to a position wherein said check valve poppet opens said fluid inlet passage and wherein said exhaust port seal closes said exhaust passage to effect an intake stroke of said motor piston;

and means, including a fluid port in said motor chamber connected to said bore, for directing fluid from said motor chamber to said piston portion in said bore to move said check valve poppet against the bias of said biasing means when said motor piston nears the end of its intake stroke whereby said check valve poppet closes said intake passage and whereby said exhaust port seal opens said exhaust passage to effect an exhaust stroke of said motor piston;

said exhaust port seal being engagable with and movable by said motor piston when the latter nears the end of its exhaust stroke to effect closure of said fluid exhaust passage and opening of said fluid inlet passage.

6. In a fluid motor energizable from a source of pressurized fluid:

a body;

a motor chamber in said body;

a motor piston in said motor chamber movable through an intake stroke and an exhaust stroke away from and toward, respectively, an end of said motor chamber;

a bore in said body at said end of said motor chamber;

a fluid inlet passage in said body for supplying fluid from said source to said motor chamber, said fluid inlet passage including one portion of said bore and a fluid inlet port;

a throttle valve in said fluid inlet passage;

a fluid exhaust passage in said body for exhausting fluid from said motor chamber, said fluid exhaust passage including another portion of said bore and a fluid exhaust port;

a shuttle valve poppet including a piston portion movable in said bore between said one portion and said other portion thereof and an exhaust port seal;

a check valve poppet in said one portion of said bore for controlling said fluid inlet port;

said exhaust port seal located in said motor chamber for controlling said fluid exhaust port, said exhaust port seal being engagable with and movable by said motor piston when the latter nears the end of its exhaust stroke to effect closure of said fluid exhaust port and opening of said fluid inlet port;

means for connecting said check valve poppet and said shuttle valve poppet for movement therewith;

biasing means in said bore for continuously acting on said shuttle valve poppet and for releasably biasing said shuttle valve poppet to a position wherein said check valve poppet opens said inlet port and wherein said exhaust port seal closes said exhaust port;

and means, including a fluid port in said motor chamber and a passage connecting said fluid to said bore, for directing fluid from said motor chamber to said piston portion in said bore to move said check valve poppet against the bias of said biasing means when said motor piston nears the end of its intake stroke, whereby said check valve poppet closes said intake port and whereby said exhaust port seal opens said exhaust port.

* * * * *